US007966771B2

(12) United States Patent
Bienek

(10) Patent No.: US 7,966,771 B2
(45) Date of Patent: Jun. 28, 2011

(54) DOOR OPERATOR, IN PARTICULAR SWING DOOR OPERATOR

(75) Inventor: Volker Bienek, Dortmund (DE)

(73) Assignee: Dorma GmbH + Co. KG, Ennepetal (DE)

( * ) Notice: Subject to any disclaimer, the term of this patent is extended or adjusted under 35 U.S.C. 154(b) by 1044 days.

(21) Appl. No.: 11/793,219

(22) PCT Filed: Nov. 11, 2005

(86) PCT No.: PCT/EP2005/012091

§ 371 (c)(1),
(2), (4) Date: Jun. 18, 2007

(87) PCT Pub. No.: WO2006/066663

PCT Pub. Date: Jun. 29, 2006

(65) Prior Publication Data

US 2008/0005969 A1 Jan. 10, 2008

(30) Foreign Application Priority Data

Dec. 17, 2004 (DE) ..... 10 2004 061 624

(51) Int. Cl.
*E05F 15/02* (2006.01)

(52) U.S. Cl. ..... 49/340; 49/344; 49/137; 91/463; 60/473

(58) Field of Classification Search ..... 49/137, 49/339, 340, 344, 341; 16/56, 58; 91/463; 60/473, 476
See application file for complete search history.

(56) References Cited

U.S. PATENT DOCUMENTS

| | | | | | |
|---|---|---|---|---|---|
| 1,951,906 | A | | 3/1934 | Hansen | |
| 3,369,323 | A | | 2/1968 | Millard | |
| 3,724,023 | A | * | 4/1973 | Tillmann | 16/53 |
| 4,115,897 | A | * | 9/1978 | Zunkel | 16/49 |
| 4,376,323 | A | * | 3/1983 | Tillmann | 16/51 |
| 4,580,365 | A | * | 4/1986 | Sieg | 49/336 |
| 4,660,250 | A | * | 4/1987 | Tillman et al. | 16/58 |
| 4,785,493 | A | * | 11/1988 | Tillmann et al. | 16/53 |
| 5,417,013 | A | * | 5/1995 | Tillmann | 49/386 |
| 5,468,042 | A | * | 11/1995 | Heinrichs et al. | 296/146.4 |
| 5,687,451 | A | * | 11/1997 | Singer | 16/71 |

(Continued)

FOREIGN PATENT DOCUMENTS

DE 32 02 966 8/1983

(Continued)

OTHER PUBLICATIONS

Search Report dated Feb. 16, 2006 for the underlying International Application No. PCT/EP2005/012091.

(Continued)

*Primary Examiner* — Jerry Redman
(74) *Attorney, Agent, or Firm* — Cohen Pontani Lieberman & Pavane LLP

(57) ABSTRACT

A door operator includes a housing, a first pressure compartment; a second pressure compartment, a drive unit disposed in the housing and coupleable to a door via an output shaft, the driving unit being associated with the first pressure compartment, a hydraulic pump in hydraulic connection with the first and second pressure compartments, a motor in driving relationship with the hydraulic pump, and a spring force accumulator disposed in the housing. The spring force accumulator is associated with the second pressure compartment and coupled to the drive unit.

7 Claims, 2 Drawing Sheets

U.S. PATENT DOCUMENTS

| | | | | | |
|---|---|---|---|---|---|
| 5,687,507 | A | * | 11/1997 | Beran | 49/340 |
| 5,802,670 | A | * | 9/1998 | Bienek | 16/53 |
| 5,862,630 | A | * | 1/1999 | Krumhauer et al. | 49/341 |
| 5,901,412 | A | | 5/1999 | Jentsch et al. | |
| 6,151,753 | A | * | 11/2000 | Salutzki | 16/62 |
| 6,223,469 | B1 | | 5/2001 | Moll | |
| 6,412,224 | B1 | | 7/2002 | Feucht et al. | |
| 6,442,795 | B1 | | 9/2002 | Chen | |
| 6,618,899 | B1 | * | 9/2003 | Ginzel et al. | 16/62 |
| 6,889,501 | B2 | | 5/2005 | Busch | |
| 6,957,533 | B1 | | 10/2005 | Olsson | |
| 6,978,609 | B2 | * | 12/2005 | Busch | 60/460 |
| 7,571,515 | B2 | * | 8/2009 | Fischbach et al. | 16/79 |
| 7,650,669 | B2 | * | 1/2010 | Bienek | 16/71 |
| 2003/0213092 | A1 | * | 11/2003 | Fischbach et al. | 16/52 |
| 2004/0182234 | A1 | | 9/2004 | Busch | |
| 2006/0075684 | A1 | | 4/2006 | Hansch et al. | |
| 2008/0127562 | A1 | | 6/2008 | Bienek | |

FOREIGN PATENT DOCUMENTS

| | | | |
|---|---|---|---|
| DE | 40 38 720 | | 6/1992 |
| DE | 40 41 824 | | 6/1992 |
| DE | 295 21 068 | | 8/1996 |
| DE | 197 56 496 | | 7/1999 |
| DE | 10031403 | A1 | 1/2002 |
| DE | 102 61 224 | | 5/2004 |
| EP | 492175 | A1 | 7/1992 |
| EP | 1 092 829 | | 4/2001 |
| WO | WO 00/66864 | | 11/2000 |
| WO | WO 2004/106681 | | 12/2004 |

OTHER PUBLICATIONS

Search Report dated Feb. 10, 2006 for the co-pending International Application No. PCT/EP2005/012082.

Search Report dated Feb. 13, 2006 for the co-pending International Application No. PCT/EP2005/012090.

Search Report dated Jan. 27, 2006 for the co-pending International Application No. PCT/EP2005/012165.

Search Report dated Feb. 24, 2006 for the co-pending International Application No. PCT/EP2005/012164.

Search Report dated Mar. 13, 2006 for the co-pending International Application No. PCT/EP2005/012166.

Written Communication of the International Search Authority issued for the underlying International Application No. PCT/EP2005/012091, Feb. 16, 2006.

* cited by examiner

DOOR OPERATOR, IN PARTICULAR SWING DOOR OPERATOR

CROSS-REFERENCE TO RELATED APPLICATIONS

This is a U.S. national stage of International Application No. PCT/EP2005/012091, filed on 11 Nov. 2005. Priority is claimed on German Application No. 10 2004 061 624.8, filed on 17 Dec. 2004.

BACKGROUND OF THE INVENTION

1. Field of the Invention

The invention relates to a door operator, in particular a swing door operator.

2. Description of the Related Art

Such a door operator is known from DE 295 21 068 U1. An overhead door closer with a slide rail linkage is known from DE 40 38 720 C2, which has a cam drive unit allowing for an optimum door moment curve and a comfortable operation. In principle this overhead door closer would thus be suitable as a door operator as well; however, experiments conducted during the course of the invention have shown that applying oil pressure to the drive unit results in a very unfavourable transformation of the hydraulic pressure into the resulting movements of stroke/rotation and repeated stroke. Since about 75% of the output capacity to be applied is required for loading the spring force accumulator of such a door closer, whereas only about 25% of the output capacity needs to be delivered by the system for accelerating the door. As it is furthermore desirable to keep the narrow structure of such a door closer for door operators as well, the dimensions of the structural components cannot be adapted to the extreme high loads. Thus, although functionally and technically advantageous, the known overhead door closer is not suitable as a door operator.

Another swing door operator is known from DE 197 56 496 C2. This swing door operator has an electromechanical drive unit, which is provided with a drive motor and a gear and with a subsequent power transmission unit for the connected door. The power transmission unit has a spindle with a spindle nut partially overlapping the former, which spindle is non-positively and positively connected to a toothed rack. Although this swing door operator can be installed concealed, the door moment curve is not as optimal as with the above described door closers having the cam technology. However, on account of the larger construction width, installation in standard profiles is not possible.

SUMMARY OF THE INVENTION

Therefore, it is an object of the present invention to provide a door operator, in particular a swing door operator which can be installed completely concealed within the door profile or frame profile, and does not require any special constructions of the door system.

The solution of the problem is achieved by a door operator comprising a housing, a first pressure compartment, a second pressure compartment, a drive unit disposed in the housing and coupleable to a door via an output shaft, the driving unit being associated with the first pressure compartment, a hydraulic pump in hydraulic connection with the first and second pressure compartments, a motor in driving relationship with the hydraulic pump, and a spring force accumulator disposed in the housing. The spring force accumulator is associated with the second pressure compartment and coupled to the drive unit.

On account of its compact structure, the inventive door operator allows for a concealed installation within the door profile or frame profile and thus allows for a total integration with the door system.

Particularly the installation in common narrow door profiles is possible.

As an advantage, neither special door profiles nor any special constructions, which would interfere with the design of the door system, are necessary. Another advantage results from an economical mounting combined with a wide applicability and, moreover, it is possible to retrofit existing door systems with the inventive door operator. Another advantage results from the fact that, in the inventive door operator, a direct introduction of power for loading a spring force accumulator is possible allowing to operate the closing of the door without any additional auxiliary energy. Such a door operator is thus unconditionally suitable for fire-rated doors. Therefore, the possibility is given of avoiding unnecessarily loading the mechanical structural components and of lowering the required operating pressure, because larger effective piston areas are provided. This construction results furthermore in the advantage of having a larger stroke volume, thus improving the operational range for common hydraulic pumps.

As the hydraulic pump of the inventive door operator is in hydraulic connection with a separate pressure compartment, which is directly associated to the spring force accumulator, a direct pressure application and thus a direct introduction of force into/onto the spring force accumulator is the result, whereby the pre-loading of the spring force accumulator is completely or at least partially achieved. By this measure, the disadvantages explained in the introduction are completely eliminated.

As the output capacity, to be performed for opening a door, in particular a swing door, with a door operator which is provided with the spring force accumulator for the closing operation and for fire-rated suitability, is divided into two magnitudes of force or torque, it is advantageous in the inventive door operator that, by assigning separate pressure compartments to the drive unit and to the spring force accumulator, a lower oil pressure can be applied to the drive unit, because the torque, required for opening and accelerating the door, at the output shaft of the drive unit is lower than the one for pre-loading the spring force accumulator. Experiments conducted during the course of the invention have shown that, depending on the size of the door and the weight of the door, as an approximate approach, about ⅔ to ¾ of the total drive power are required for pre-loading the spring force accumulator, whereas only ¼ to ⅓ of the total power is required as drive moment for opening the door.

As, in the inventive door operator, dividing this total output capacity is made possible by providing separate pressure compartments, a direct pressurizing of the spring force accumulator is achieved, and it is thus possible to directly utilize the major part of the total output capacity, without redirection, for pre-loading the spring force accumulator. Therefore, there is no unnecessary stress on structural components, no load on bearings, and neither any loss on account of friction nor loss of efficiency. On account of the separate pressure compartment associated to the spring force accumulator, the effective piston areas for loading the spring force accumulator and thus for generating a higher driving torque are increased and, moreover, the required system pressure is thus considerably lowered and the stroke volume increased. As a consequence, the control response during the closing operation is improved and the overall hydraulic system becomes less sensitive. It appears that the effective individual piston area is smaller on account of the annular chamber; however, the overall piston area is larger.

Furthermore, on account of the higher volume flow/lower pressure ratio, a small sized hydraulic pump can be used, which pump characteristics can be considerably flatter, making the pump simpler, from the technical point of view, and less expensive. Furthermore, it is preferably possible to use pressure control valves or pressure limiting valves in the feeding lines or to use different hydraulic pumps for the respective pressure compartments such that, if required, a division and adaptation of the forces of the different pistons, such as damping, spring loading, and/or opening pistons, is possible.

It can thus be achieved that the torque required at the output shaft for opening the doors can be generated by means of a damping piston and a cam arrangement, whereas the spring loading work is generated independently therefrom in the additional separate pressure compartment.

Through providing the pressure compartment, associated to the spring force accumulator, which compartment corresponds to the realization of another pressure means compartment corresponding to the stroke, and a preferably provided specific hydraulic control, such as by using a solenoid valve, further hydraulic functions such as freewheeling, hydraulic hold-open, or a hydraulic closing sequence control are made possible.

It is understood that the invention is not limited to the creation of only one additional pressure compartment, obviously more pressure compartments can be created in addition. These pressure compartments are connected in series in order to lower the pressures and to simultaneously increase the forces.

Furthermore, it is possible to realize a hydraulic opening damping and to use differently built drive units.

BRIEF DESCRIPTION OF THE DRAWINGS

Further details, features and advantages of the invention will become apparent from the following description of exemplary embodiments, reference being made to the Figures, in which.

DETAILED DESCRIPTION OF THE PREFERRED EMBODIMENTS

Figure 1:
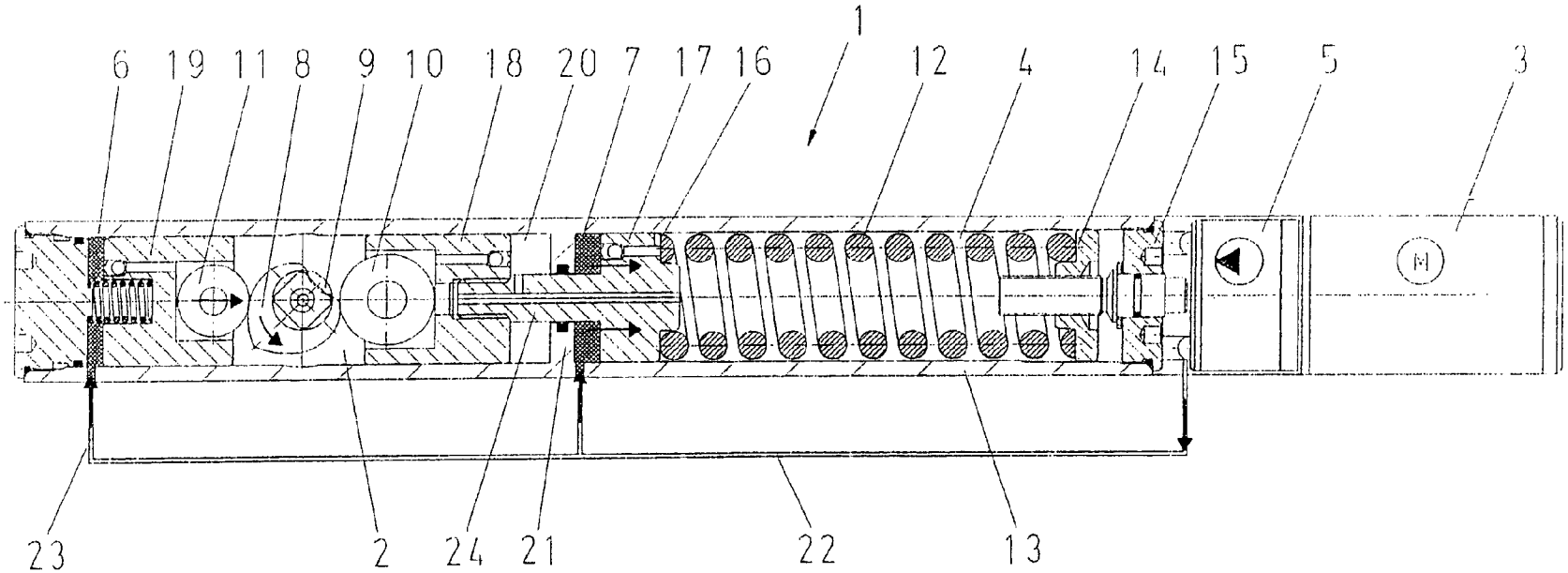
FIG. 1 shows a diagrammatically simplified basic illustration of an embodiment of an inventive door operator.

FIG. 1 shows an inventive door operator 1, which in particular may be executed as a swing door operator. The door operator 1 has a drive unit 2, which, via an output shaft 9, can be coupled to a door not illustrated in FIG. 1, for example via a lever and a slide channel with a sliding member. The drive unit 2 is disposed in a housing 13.

Furthermore, the door operator 1 has a motor 3 as well as, disposed in the housing 13, a spring force accumulator 4, which is coupled to the motor 3 and the drive unit 2. The motor 3 can be, for example, an alternating current micro-motor or a direct current micro-motor.

As depicted in FIG. 1, the motor 3 is in driving connection with a hydraulic pump 5. In the illustrated embodiment, the motor 3 and the pump 5 are flange-mounted to the housing 13. However, it is conceivable that the motor 3 and the pump 5 are disposed separately or are integral with the housing 13. The motor 3, via the hydraulic pump 5 and a first hydraulic line 22, is in hydraulic connection with a pressure compartment 7, which is associated to the spring force accumulator 4. Via a second hydraulic line 23, the motor 3 and the pump 5 are in hydraulic connection with a pressure compartment 6, which is associated to the drive unit 2. This disposition allows to divide the required pressures or forces for opening the door and for loading the spring force accumulator 4, which in the exemplary case has a compression spring 12, resulting in the advantages explained at the beginning. As a division of the pressures is only conditional, a division of the forces resulting therefrom, such as generating torque and spring loading, is more important.

In the embodiment illustrated in FIG. 1, the drive unit 2 is formed as a cam drive. This cam drive has a cam disc 8, which is disposed on the output shaft 9. The cam disc 8 cooperates with two force transmission rollers 10 and 11, which are disposed on both sides of the output shaft 9 and bear on cam paths of the cam disc 8. This structure corresponds in principle to the structure of the overhead door closer of DE 40 38 720 C2, the content thereof being incorporated herein by reference.

The force transmission roller 11 is disposed at a damping piston 19, which is supported in the housing 13 adjacent to the pressure compartment 6.

The force transmission roller 10 is disposed at an opening piston 18, which is likewise supported in the housing 13 and adjoins a compartment 20, which is separated from the separate pressure compartment 7 via a separating wall 21.

As revealed in FIG. 1, a spring loading piston 17, which directly induces the force for loading the compression spring 12 into the latter, is disposed in the pressure compartment 7. It is likewise possible to increase the number of the pressure compartments 7. The spring loading piston 17 is connected to the opening piston 18 via a piston rod 24, which is sealed and passes through the separating wall 21.

FIG. 1 shows furthermore that the compression spring 12 with one end 14, via a spring force adapter, bears against a housing wall 15 of the housing 13, whereas its other end 16 bears against the piston 17.

As revealed in FIG. 1, these divided pressure compartments first of all result in the option, preferably through suitable hydraulic control means (solenoid valves, throttles, or the like), to carry out a division of the required pressures for loading the compression spring 12 and for opening the door, and thus to exploit the advantages of the cam technology. A further result is the extremely compact design, as explained at the beginning, which allows for a completely concealed installation in door profiles or frame profiles.

Figure 2:
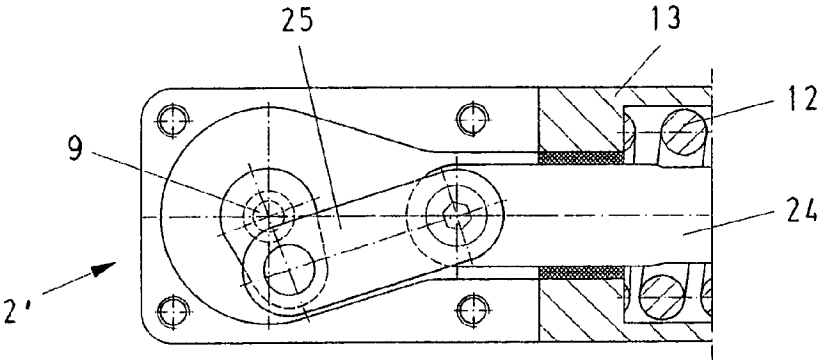
FIG. 2 shows an alternative embodiment of the drive unit of the door operator.

FIG. 2 illustrates an alternative for a drive unit 2', which is formed as a connecting-rod drive. Herein, the force for opening the door or for rotating the shaft 9 is transmitted via a connecting-rod assembly 25, which is known per se.

Figure 3:
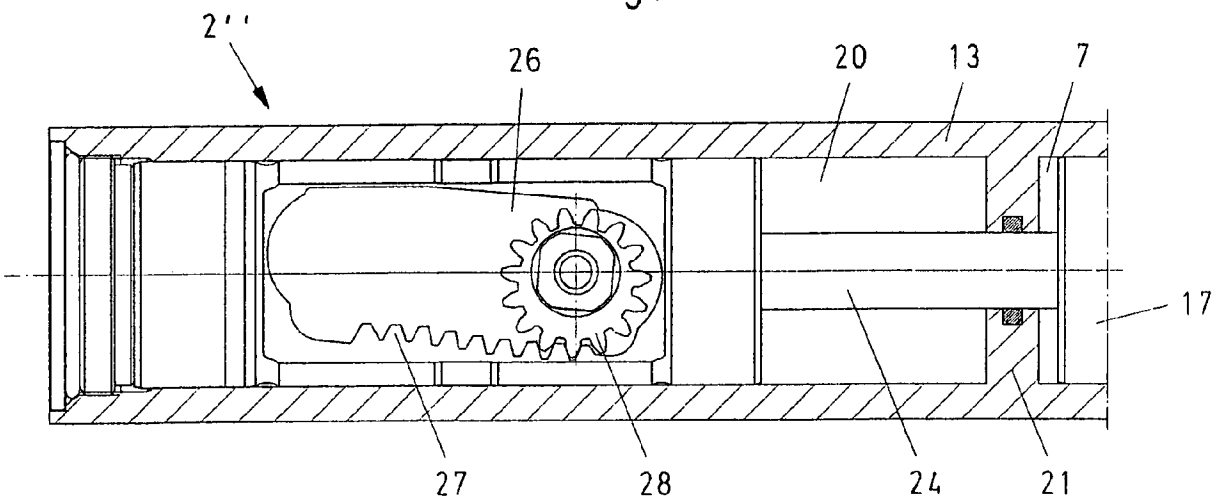
FIG. 3 shows another alternative embodiment of the drive unit of the inventive door operator.

FIG. 3 illustrates an alternative embodiment for the drive unit, which in this Figure is indicated by the reference numeral 2". In this case, it is a toothed rack drive 26, known per se, which, via an internal toothing 27 inclined towards the axis of the housing 13, transmits the opening force onto a pinion 28. The embodiment variant may be likewise realized with a linear not-inclined internal toothing.

What is claimed is:

1. A door operator, comprising:

a housing;

an output shaft;

a drive unit disposed in a drive unit compartment of the housing and configured to be coupled to a door via the output shaft, the drive unit comprising:

a cam drive having a cam disc disposed on the output shaft; and two force transmission rollers disposed on opposite sides of a longitudinal axis of the output shaft that bear on cam paths of the cam disc;

a motor, in driving connection with the drive unit;

a spring force accumulator coupled to the motor and arranged in the housing and is connected to the drive unit;

a hydraulic pump configured to be driven by the motor in hydraulic connection with a drive unit pressure compartment;

at least one pressure compartment disposed adjacent to a spring tensioning piston associated with the spring force accumulator such that a division of pressure for opening the door and for tensioning the spring force accumulator occurs, wherein the pressures act in a direction of tension of the spring force accumulator; and a fluid-tight separating wall configured to separate the at least one pressure compartment from the drive unit pressure compartment.

2. The door operator according to claim 1, wherein the spring force accumulator further comprises a compression spring, having a first end that bears against a housing wall and a second end that bears against the spring tensioning piston.

3. The door operator according to claim 2, wherein the spring tensioning piston is connected to an opening piston of the drive unit, the opening piston carrying one of the force transmission rollers.

4. The door operator according to claim 3, wherein the drive unit pressure compartment is disposed adjacent a damping piston that carries the other force transmission roller.

5. The door operator according to claim 4, wherein the motor is one of an alternating current and direct current micro-motor.

6. The door operator according to claim 1, wherein the motor is one of an alternating current and direct current micro-motor.

7. The door operator according to claim 1, wherein the door operator is configured as a swing door operator.

* * * * *